US010655929B2

(12) United States Patent
Stewart

(10) Patent No.: US 10,655,929 B2
(45) Date of Patent: May 19, 2020

(54) UNIVERSAL GUN RAIL MOUNT FOR ACCESSORIES

(71) Applicant: David A. Stewart, Boca Raton, FL (US)

(72) Inventor: David A. Stewart, Boca Raton, FL (US)

( * ) Notice: Subject to any disclaimer, the term of this patent is extended or adjusted under 35 U.S.C. 154(b) by 0 days.

(21) Appl. No.: 16/193,355

(22) Filed: Nov. 16, 2018

(65) Prior Publication Data

US 2019/0145731 A1 May 16, 2019

Related U.S. Application Data

(60) Provisional application No. 62/587,283, filed on Nov. 16, 2017.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)

(58) Field of Classification Search
CPC ..... F41G 11/003; F41G 11/004; F41C 27/00
USPC ..... 42/90, 124, 127, 106
See application file for complete search history.

(56) References Cited

U.S. PATENT DOCUMENTS

2008/0216380 A1* 9/2008 Teetzel ..... F41G 11/003 42/127
2015/0316355 A1* 11/2015 Boswell ..... F41G 11/004 42/146
2017/0241735 A1* 8/2017 Burge ..... G03B 17/561
2017/0254615 A1* 9/2017 Kennair, Jr. ..... F41C 27/00

* cited by examiner

*Primary Examiner* — Bret Hayes
(74) *Attorney, Agent, or Firm* — Fleit Intellectual Property Law; Jon Gibbons

(57) ABSTRACT

A gun rail accessory mounting system that is symmetrical in both the Y axis, forward to backwards plane, and in the Z axis, over and under plane is described. Additionally, the two mounting brackets can have similar external dimensions and form factors to allow full 3 axis symmetry. This symmetry allows for an accessory to be mounted on gun rails of the PICATINNY, WEAVER, GLOCK, or any other rail type, where a recoil locking slot is used.

12 Claims, 13 Drawing Sheets

UNIVERSAL GUN RAIL MOUNT FOR ACCESSORIES

FIELD OF THE INVENTION

This invention is directed to fire arms and more specifically to a gun rail accessory mounting system.

BACKGROUND OF THE INVENTION

As gun rail mounting systems progressed from the Weaver type to the Picatinny type there were other variants that were custom to a particular manufacturer such as Glock. This resulted in the unsatisfactory situation where Picatinny rail accessories were not backwards compatible with Weaver mounts and neither of those were compatible with manufacturers custom mounts such as Glock.

Accessory companies either offered unique mounting hardware for the different rail types or in some cases offered different plastic inserts that would fit the different widths of recoil locking slots.

This invention has specific application in the mounting of a video camera where the ability to have the camera mounted on the gun rail facing in either direction and also allowing the mounting hardware to be flipped forwards to backwards and up or down gives the user four times as many position options as the typical rail mounting hardware.

SUMMARY OF THE INVENTION

Further, this invention is symmetrical in both the Y axis, forward to backwards plane, and in the Z axis, over and under plane. Additionally, the two mounting brackets can have identical external dimensions and form factor to allow full 3 axis symmetry. This symmetry allows for an accessory to be mounted on gun rails of the Picatinny, Weaver, Glock, or any other rail type, where a recoil locking slot is used, by simply inserting a screw in the appropriate screw hole. More particularly, the present invention allows for mounting an accessory, such as a video camera, that can point forwards or backwards relative to the gun muzzle while also allowing the user to have the recoil locking screw in various positions towards the forward or back of the mount depending on where on the rail the user desires the accessory to be mounted. Accordingly, the present invention is directed, in part, to a system and method for the mounting of accessories on a gun rail where the user is not limited to any particular orientation of the mounting hardware comprising:

(a) Two mounting brackets.

(b) One or more fasteners to hold the two mounting brackets together with the accessory on one side and the gun rail on the other.

(c) A series of optional screw holes to allowing a suitable screw to be used with the recoil locking slot used for the chosen gun rail.

The present invention is additionally directed, in part, to simplifying the mounting hardware manufacturing process by allowing a single common bracket mount to be made instead of multiple brackets. More particularly, it also allows for aluminum brackets to be produced using an extrusion process with a single extrusion tool.

Figure 1:
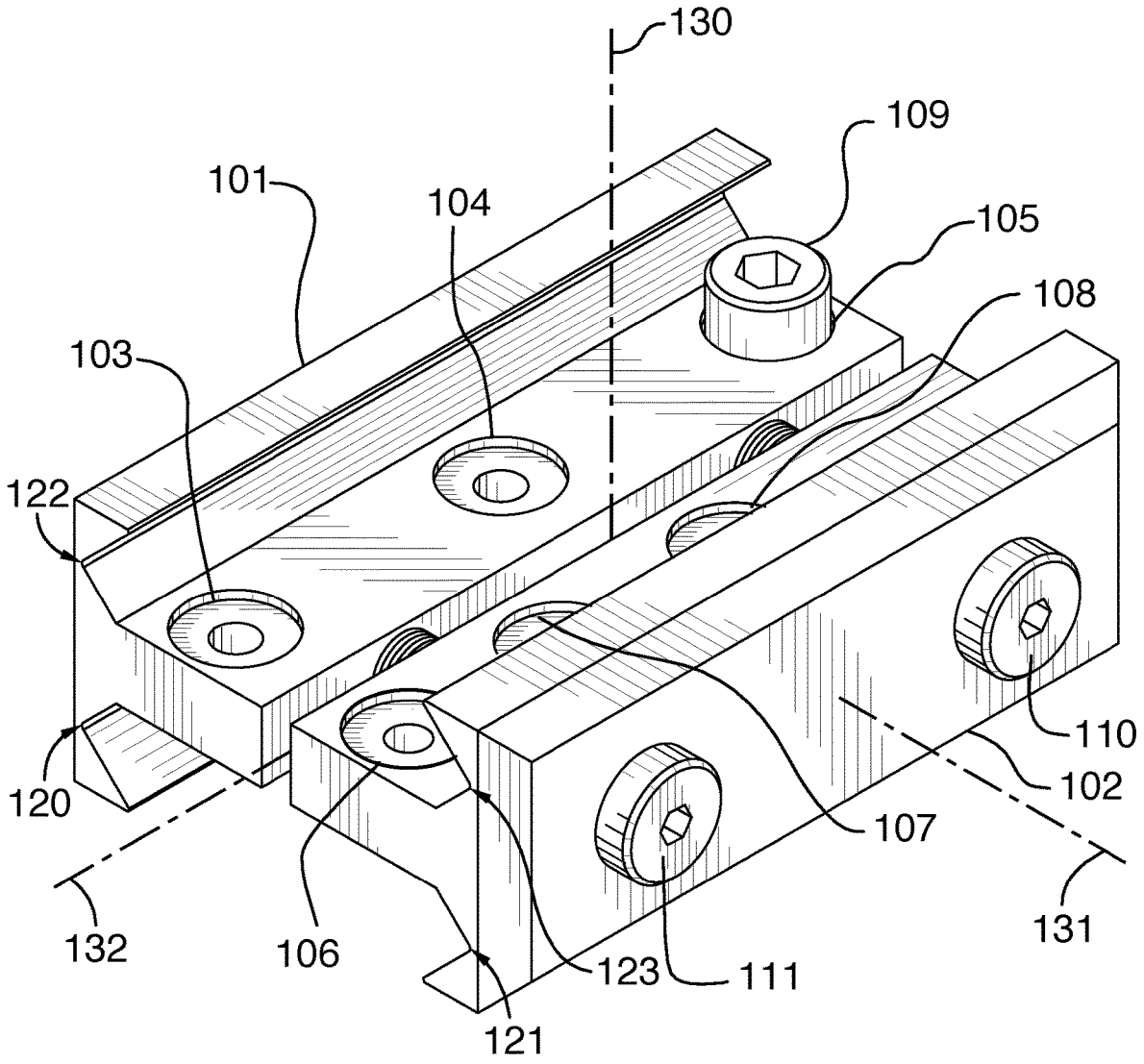
FIG. 1 shows the mounting brackets allowing 3 axis symmetry with a recoil locking screw in place.

The present invention is generally directed to the process of mounting an accessory to a gun rail. Some advantages of the methods of the present invention include, in certain embodiments, the ability to mount the accessory with the accessory pointing in either direction; the mounting hardware can be flipped on the x, y, or z axis and still fit both the accessory rail and the gun rail; a recoil retaining screw can be added to fit the recoil retaining slot in the gun rail after the optimal orientation of gun rail and accessory have been chosen.

As employed above and throughout the disclosure, the following terms, unless otherwise indicated, shall be understood to have the following meanings.

The examples provided in the definitions present in this application are non-inclusive unless otherwise stated. They include but are not limited to the recited examples.

As used herein, the term "shooting device" includes all equipment designed to launch projectiles at a target area.

As used herein, the term "gun rail" includes all rail types used to attach accessories to shooting devices.

It is believed the names used herein correctly and accurately reflect the underlying components, and process equipment. However, the nature and value of the present invention does not depend upon the theoretical correctness of these, in whole or in part. Thus, it is understood that the names attributed to the correspondingly indicated components, and process equipment are not intended to limit the invention in any way.

Accordingly, the present invention is directed, in part, to a system and method for the mounting of accessories on a gun rail where the user is not limited to any particular orientation of the mounting hardware comprising:

(a) Two mounting brackets.
(b) One or more fasteners to hold the two mounting brackets together with the accessory on one side and the gun rail on the other.
(c) A series of optional screw holes to allowing a suitable screw to be used with the recoil locking slot used for the chosen gun rail.

The present invention is additionally directed, in part, to simplifying the mounting hardware manufacturing process by allowing a single common bracket mount to be made instead of multiple brackets. More particularly, it also allows for aluminum brackets to be produced using an extrusion process with a single extrusion tool.

In certain preferred embodiments, the mounting brackets can be symmetrical in only 2 axis to allow additional variation in recoil locking screw positions.

In certain preferred embodiments, the recoil locking screw positions are asymmetrical between one bracket side and the other. This allows for more variation in the accessory position on the gun rail as the flipping of the brackets from front to back gives a different relative position of the recoil locking screw.

In certain preferred embodiments, the recoil locking screw holes are countersunk to allow a standard screw to be used and the head to be countersunk so that the protruding height of the screw from the bracket surface more closely matches the height of the recoil locking slot.

In certain preferred embodiments, the recoil locking screws are standard sized screws with the diameter of the standard screw head approximately matching the width of the recoil locking slot. Examples are a #3 screw being used for Glock rails, a #4 screw being used for Weaver rails, and a #5 screw being used for Picatinny rails.

A pictorial representation of the invention is shown in FIG. 1. These illustrations are not meant to limit the invention in any way. The brackets 101 and 102 have similar form factors but have different screw holes for the fasteners and recoil retaining screws. The two fasteners 110 and 111 pass through holes in bracket 102 and are screwed into the threaded fastener holes on bracket 101. Bracket 101 has three threaded recoil retaining screw holes 103, 104, and 105. The threaded screw holes in this example are some combination of #3, #4, and #5 sized screw holes. A #3 sized screw head fits a Glock type accessory gun rail. A #4 sized screw head fits a Weaver type accessory gun rail. A #5 sized screw head fits a Picatinny type accessory gun rail.
Bracket 102 has three threaded recoil retaining screw holes 106, 107, and 108. The threaded screw holes in this example are some combination of #3, #4, and #5 sized screw holes. Bracket 101 has one recoil retaining screw 109 in recoil retaining screw hole 105. In this example the recoil retaining screw 109 is a #5 screw and would fit in the recoil retaining slot of a Picatinny rail. The recoil retaining screw holes 103, 104, 104, 106, 107, and 108 may or may not be countersunk. In this example all the recoil retaining screw holes are countersunk. The depth of the countersinking can be selected to allow the recoil retaining screw 109 to have a height above the plane of the bracket that approximately matches the depth of the recoil retaining slot in the gun accessory rail. Also shown are a set of top triangular slots 122, 123 and a set of bottom triangular slots 120 and 121. The combination of the top and bottom triangular slots 122, 120 and 123, 121 form a W-shaped mounting bracket.

Figure 2:
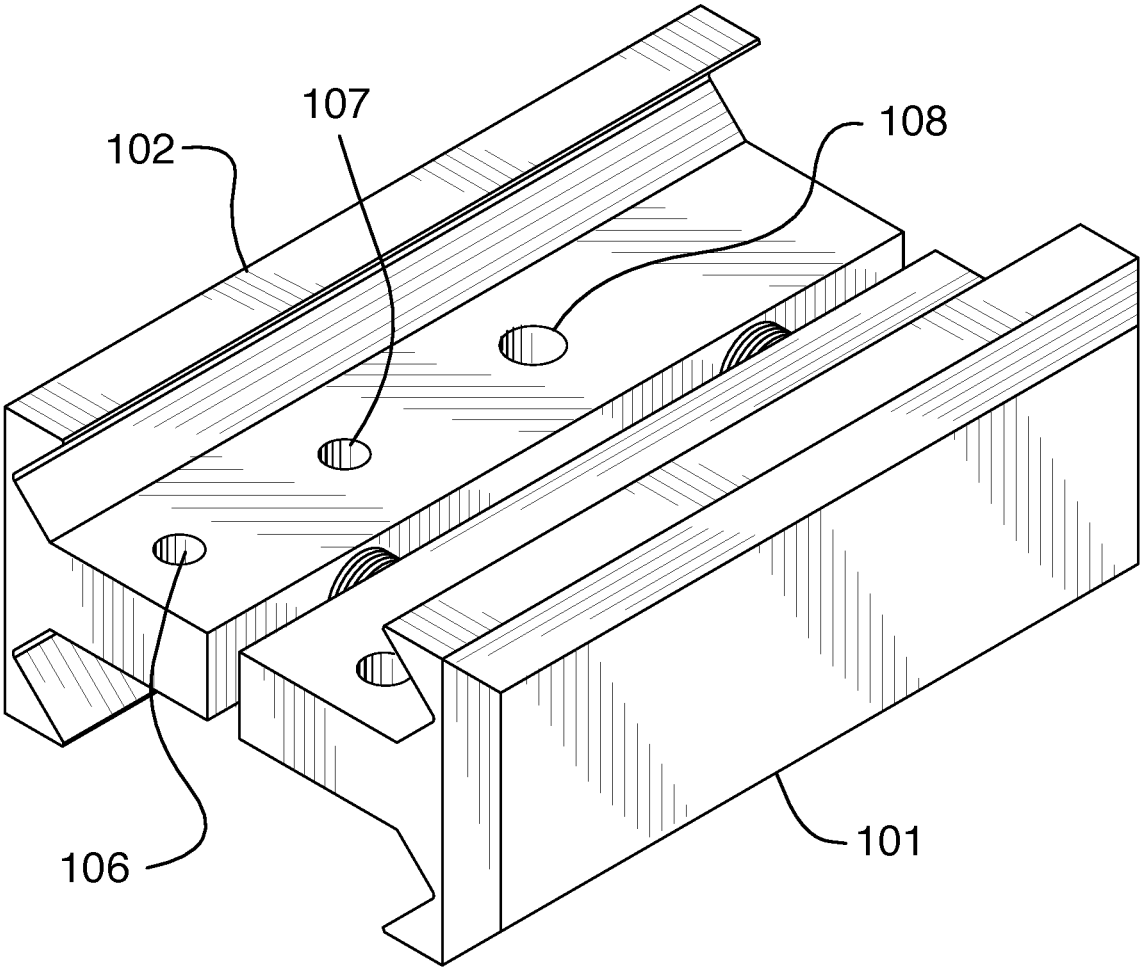
FIG. 2 shows opposite side to FIG. 1 with no recoil locking screw in place.

In FIG. 2 the brackets 101 and 102 have been inverted. The symmetry of the brackets and the ability to mount the accessory on one side or the other, and the gun rail to be on one side or the other, allows increased flexibility and additional mounting options for the accessory on the gun rail. In this example if a recoil retaining screw were inserted in retail retaining screw hole 107 there would be no countersinking and the height of the recoil retaining screw head would be selected to fit in the recoil retaining slot of the accessory gun rail.

Figure 3:
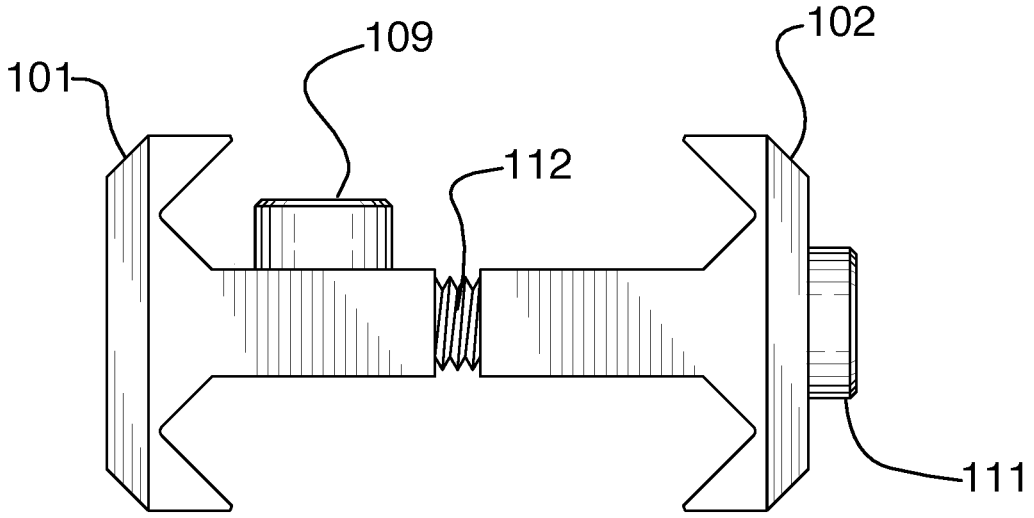
FIG. 3 shows a front view of the 3 axis symmetry mounting system.
Figure 4:
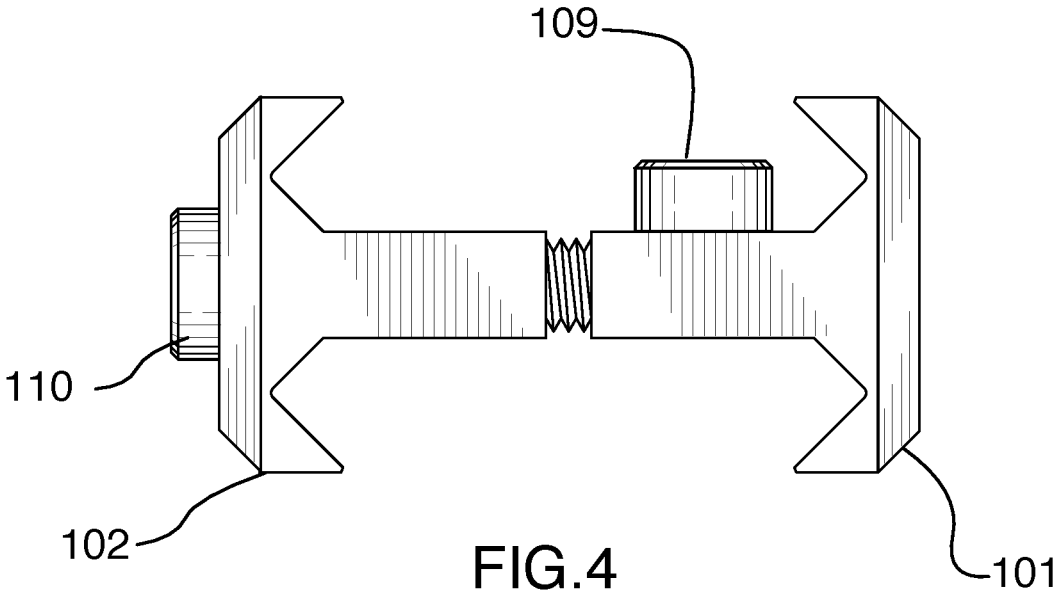
FIG. 4 shows a rear view of the 3 axis symmetry mounting system.

FIGS. 3 and 4 show the ability to rotate the mounting brackets 101 and 102 in order to give a new relative location of the recoil retaining screw head 109 and hence an additional mounting location of the accessory on the gun rail. Additionally, FIG. 3 shows the threaded part 112 of fastener 111 passing through the gap between brackets 101 and 102.

Figure 5:
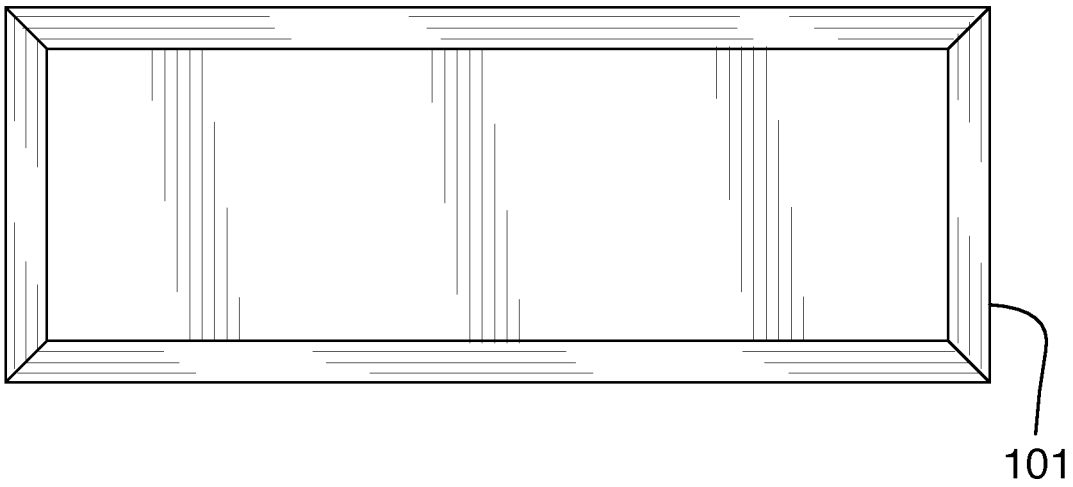
FIG. 5 shows a left side view of the 3 axis symmetry mounting system.

FIG. 5 shows the outside of bracket 101. The fastener screw holes may or may not pass through the outside wall of bracket 101. In this example the fastener screw holes do not pass through the outside wall of bracket 101.

Figure 6:
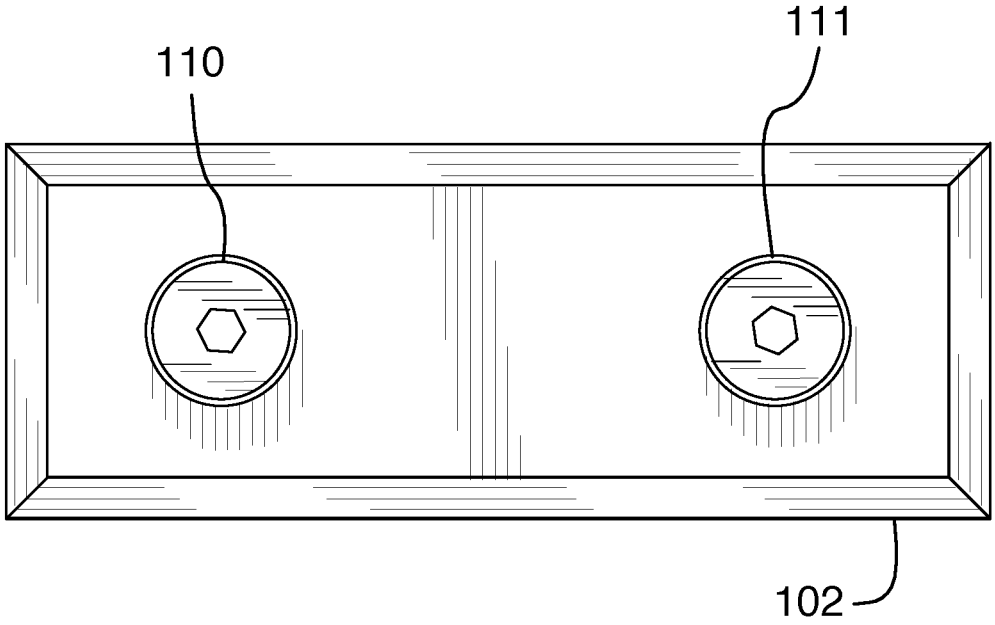
FIG. 6 shows a right side view of the 3 axis symmetry mounting system.

FIG. 6 shows the outside of bracket 102. The fasteners 110 and 111 may be of any type. In this example the fasteners are socket head screws. Any number of fasteners may be used. In this example two fasteners are used.

Figure 7:
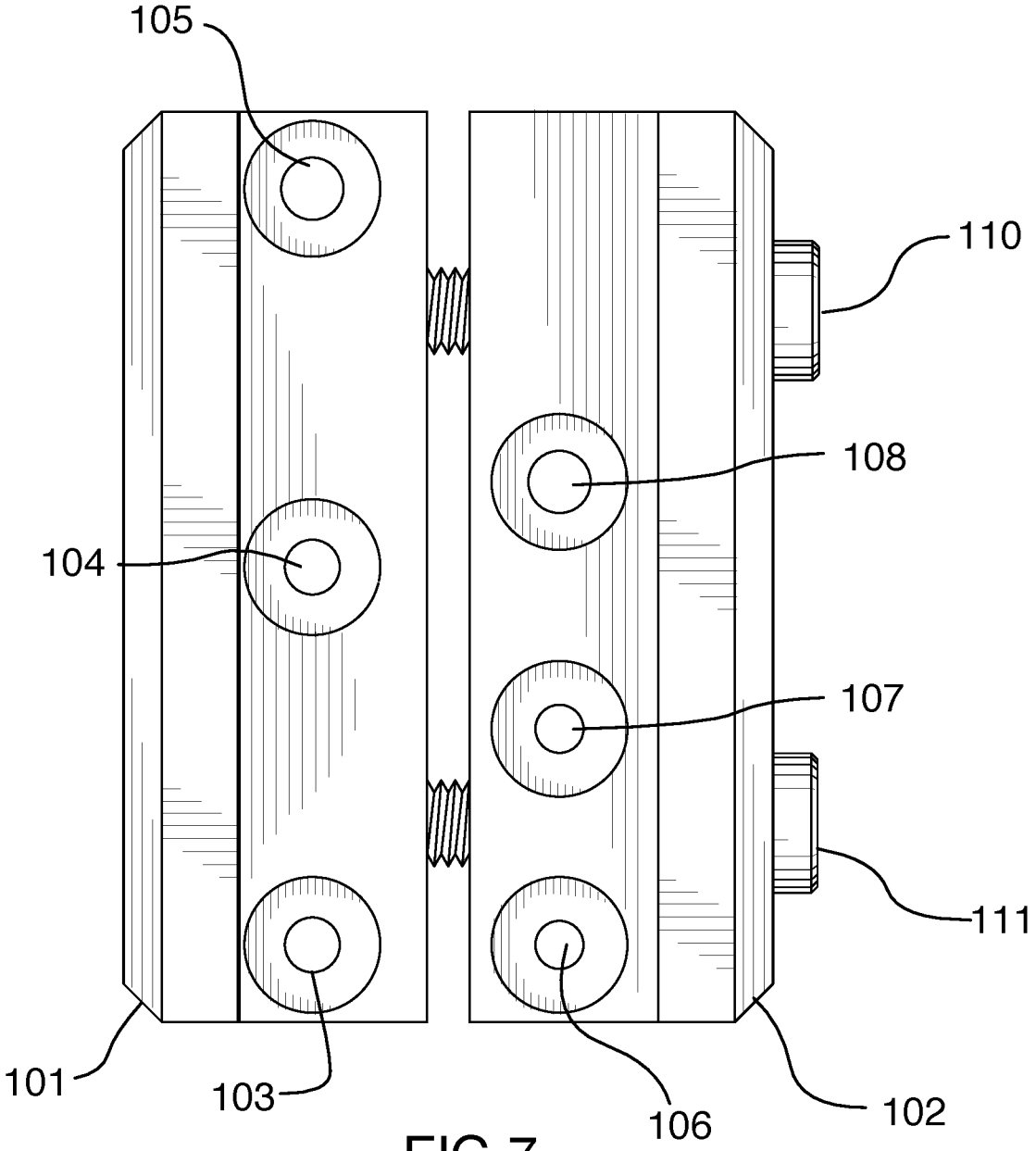
FIG. 7 shows an example of recoil locking screw hole positions with the 3 axis symmetry mounting system.

FIG. 7 shows some of the almost limitless recoil retaining screw hole positions and sizes. In this example two recoil retaining screw holes 105, and 108 are suitable for #5 screws and could be used with a Picatinny rail. Additionally, in this example two recoil retaining screws 103, and 104 are suitable for #4 screws and could be used with a Weaver rail. Additionally, in this example two recoil retaining screws 106, and 107 are suitable for #3 screws and could be used with a Glock rail. By making the recoil retaining screw hole positions asymmetrical along the length of the brackets 101 and 102 the position of the accessory on the gun rail can be varied by flipping the direction of the mounting brackets along the gun rail.

Figure 8:
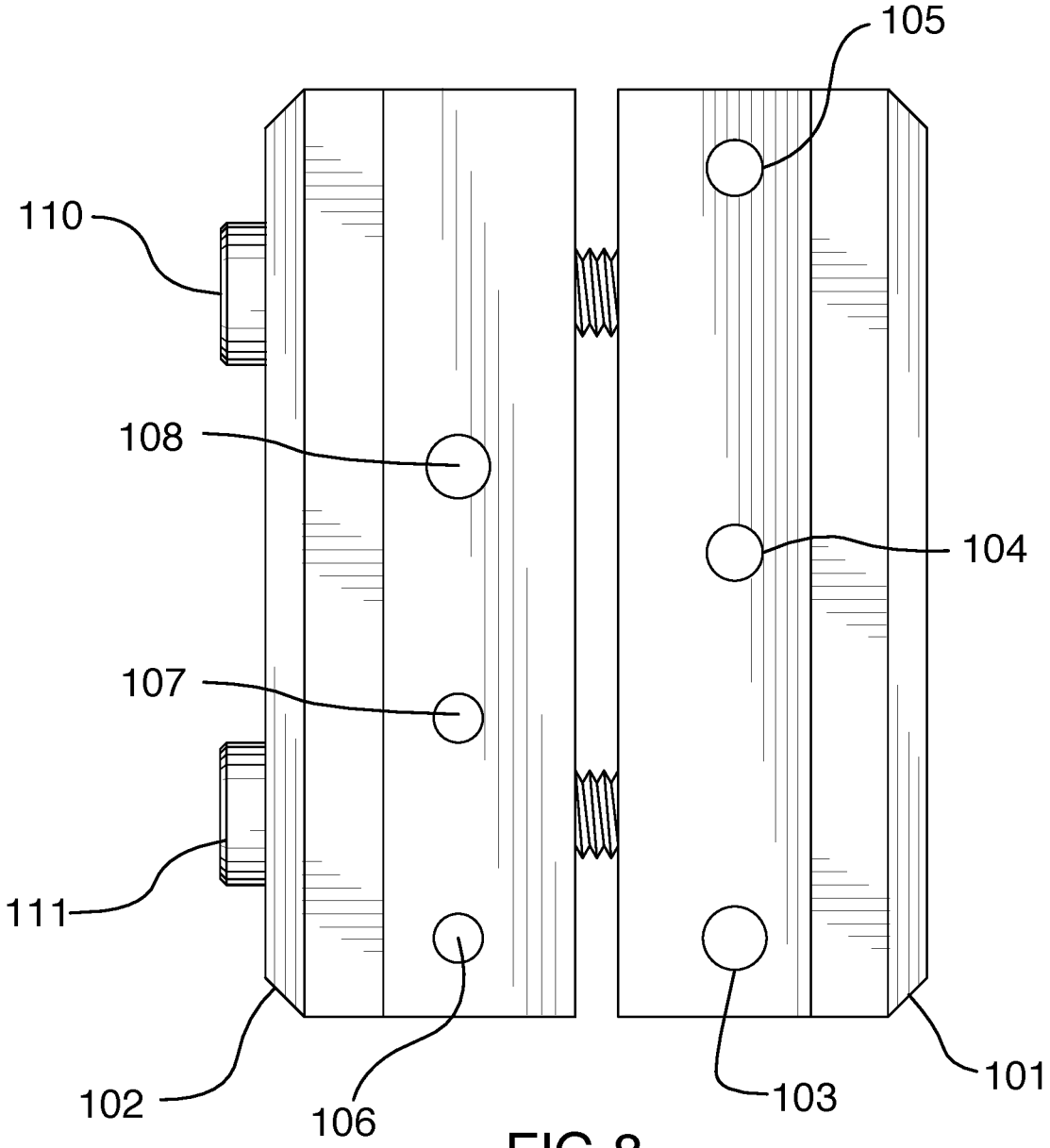
FIG. 8 shows an example of recoil locking screw hole positions on opposite side to FIG. 7.

FIG. 8 shows the opposite side to FIG. 7 and again shows that the accessory and gun rail can be on interchangeable sides of the mounting brackets 101 and 102.

Figure 9:
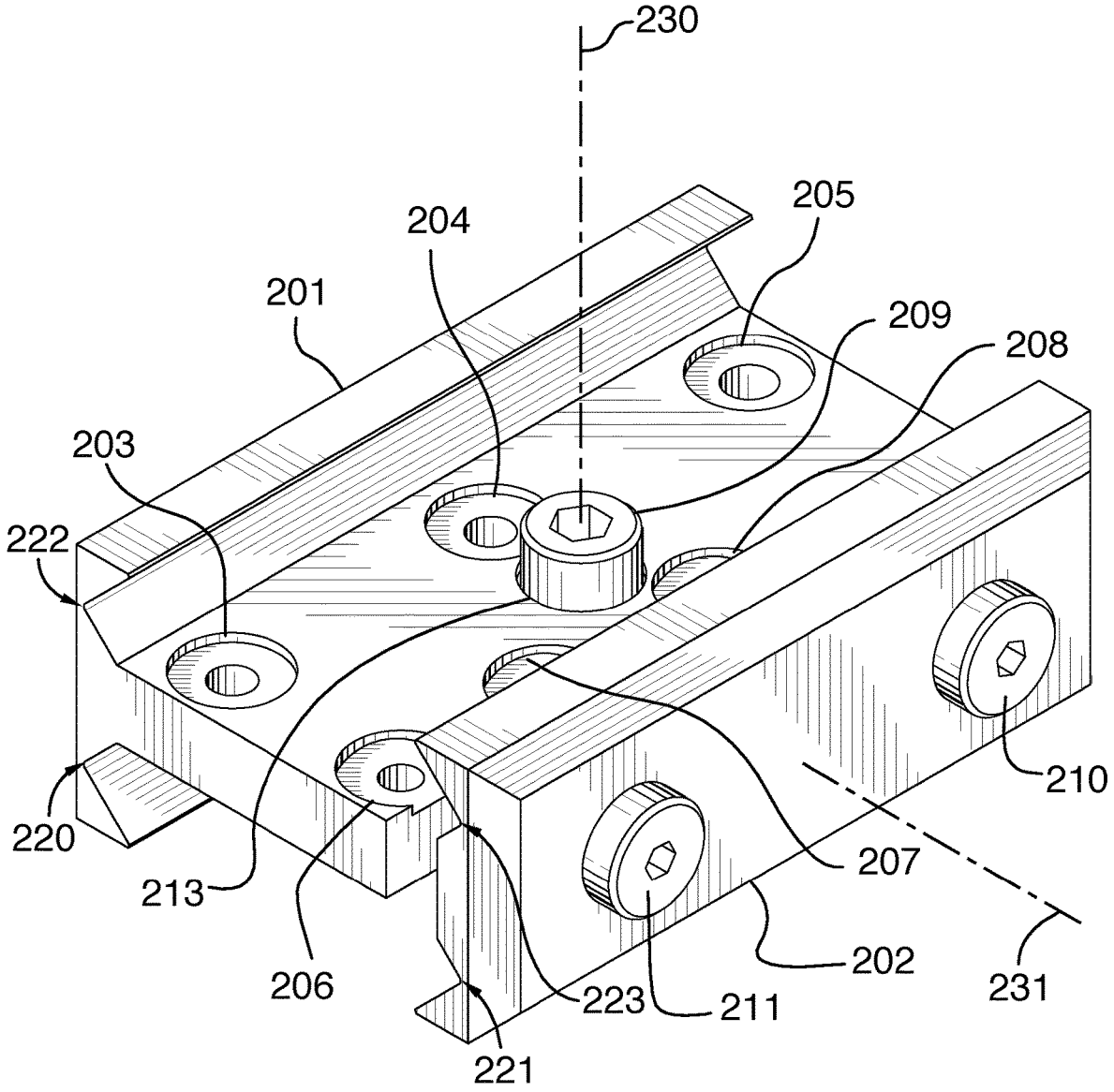
FIG. 9 shows the mounting brackets allowing 2 axis symmetry with a recoil locking screw in place.

A pictorial representation of another embodiment of the invention is shown in FIG. 9. These illustrations are not meant to limit the invention in any way. The brackets 201 and 202 have different form factors. The two fasteners 210 and 211 pass through holes in bracket 202 and are screwed into the threaded fastener holes on bracket 201. Bracket 201 has seven threaded recoil retaining screw holes 203, 204, 205, 206, 207, 208, and 213. The threaded screw holes in this example are some combination of #3, #4, and #5 sized screw holes. A #3 sized screw head fits a Glock type accessory gun rail. A #4 sized screw head fits a Weaver type accessory gun rail. A #5 sized screw head fits a Picatinny type accessory gun rail.
Bracket 201 has one recoil retaining screw 209 in recoil retaining screw hole 213. In this example the recoil retaining screw 209 is a #5 screw and would fit in the recoil retaining slot of a Picatinny rail. The recoil retaining screw holes 203, 204, 205, 206, 207, 208, and 213 may or may not be countersunk. In this example all the recoil retaining screw holes are countersunk. The depth of the countersinking can be selected to allow the recoil retaining screw 209 to have a height above the plane of the bracket that approximately matches the depth of the recoil retaining slot in the gun accessory rail. Also shown are a set of top triangular slots 222, 223 and a set of bottom triangular slots 220 and 221. The combination of the top and bottom triangular slots 222, 220 and 223, 221 form a W-shaped mounting bracket.

Figure 10:
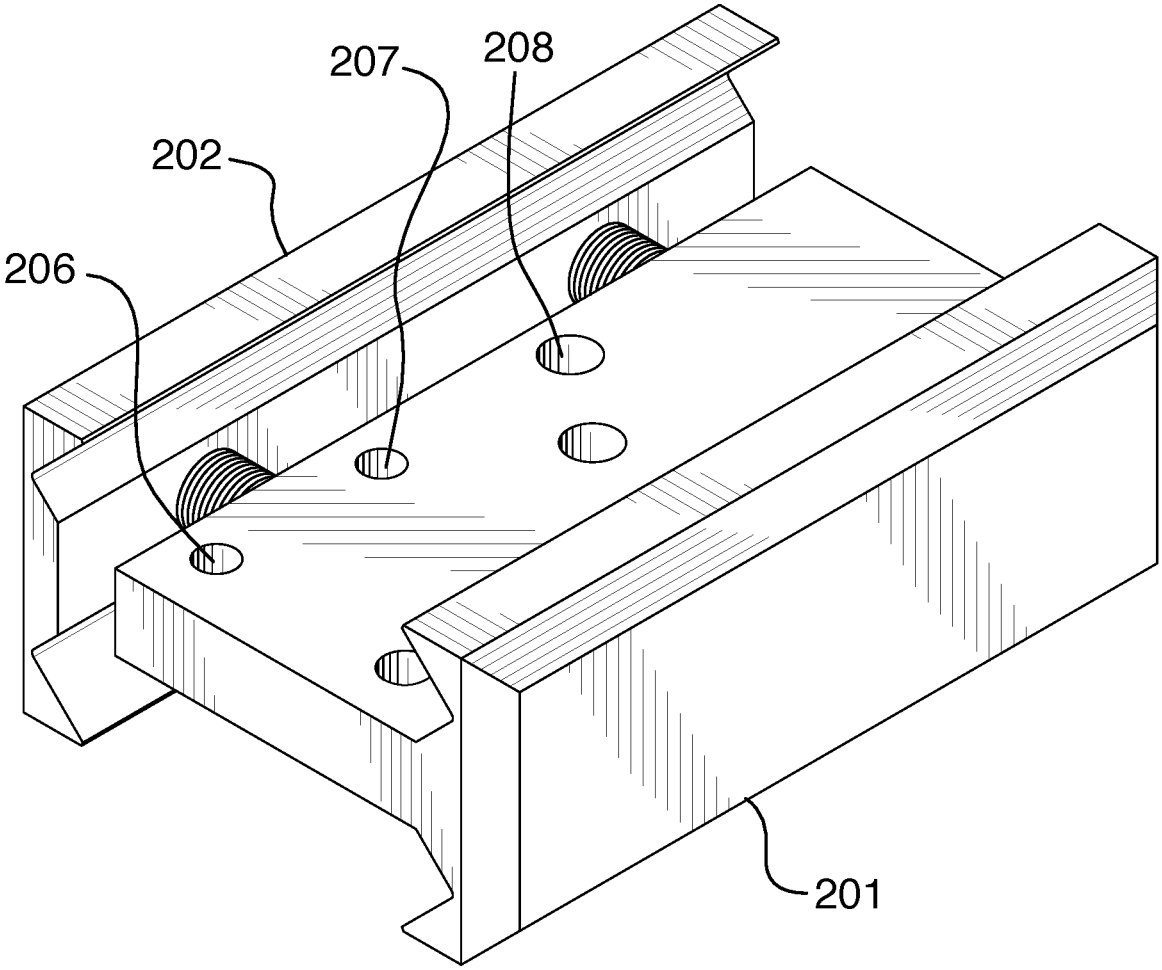
FIG. 10 shows opposite side to FIG. 9 with no recoil locking screw in place.

In FIG. 10 the brackets 201 and 202 have been inverted. The symmetry of the brackets and the ability to mount the accessory on one side or the other, and the gun rail to be on one side or the other, allows increased flexibility and additional mounting options for the accessory on the gun rail. In this example if a recoil retaining screw were inserted in retail retaining screw hole 207 there would be no countersinking and the height of the recoil retaining screw head would be selected to fit in the recoil retaining slot of the accessory gun rail.

Figure 11:
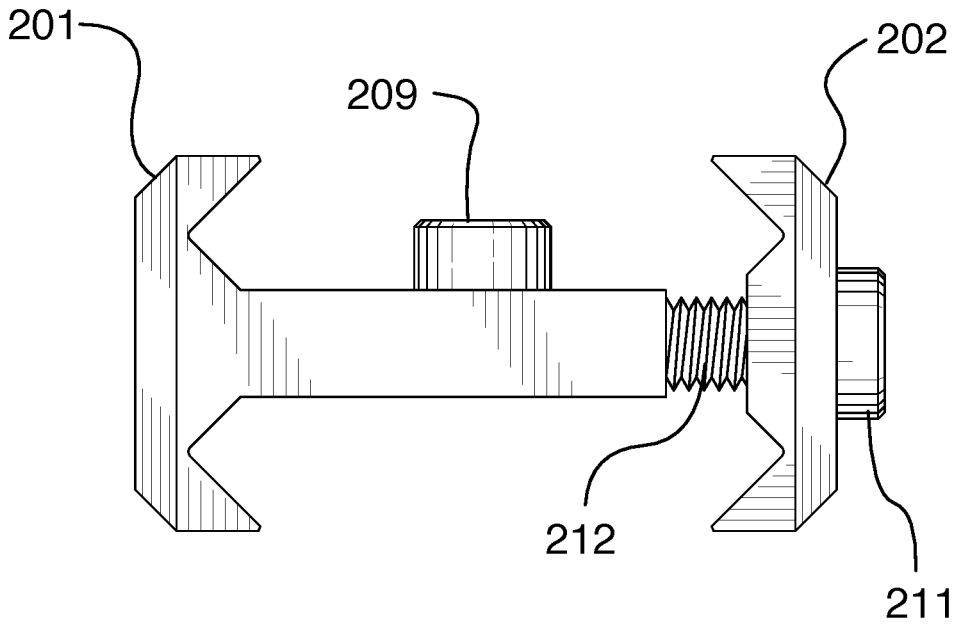
FIG. 11 shows a front view of the 2 axis symmetry mounting system.
Figure 12:
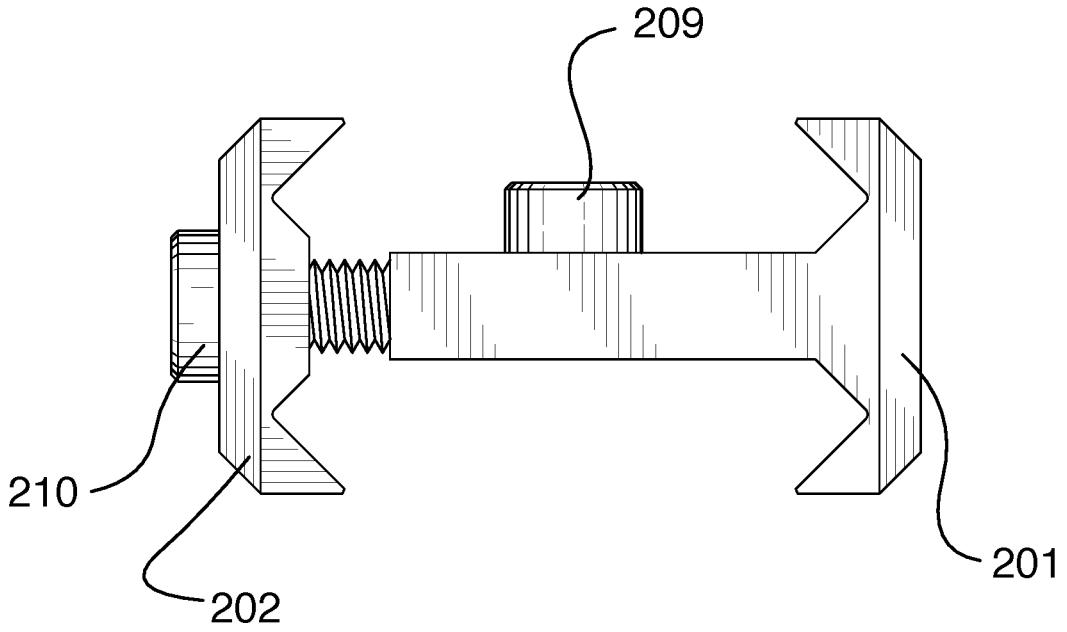
FIG. 12 shows a rear view of the 2 axis symmetry mounting system.

FIGS. 11 and 12 show the ability to rotate the mounting brackets 201 and 202 in order to give a new relative location of the recoil retaining screw head 209 and hence an additional mounting location of the accessory on the gun rail. Additionally, FIG. 11 shows the threaded part 212 of fastener 211 passing through the gap between brackets 201 and 202.

Figure 13:
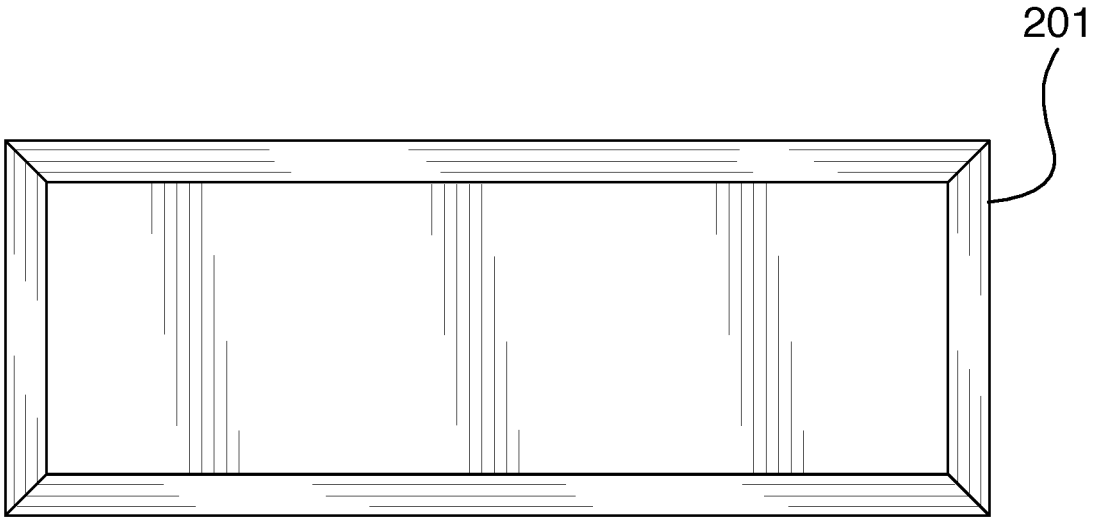
FIG. 13 shows a left side view of the 2 axis symmetry mounting system.

FIG. 13 shows the outside of bracket 201. The fastener screw holes may or may not pass through the outside wall of bracket 201. In this example the fastener screw holes do not pass through the outside wall of bracket 201.

Figure 14:
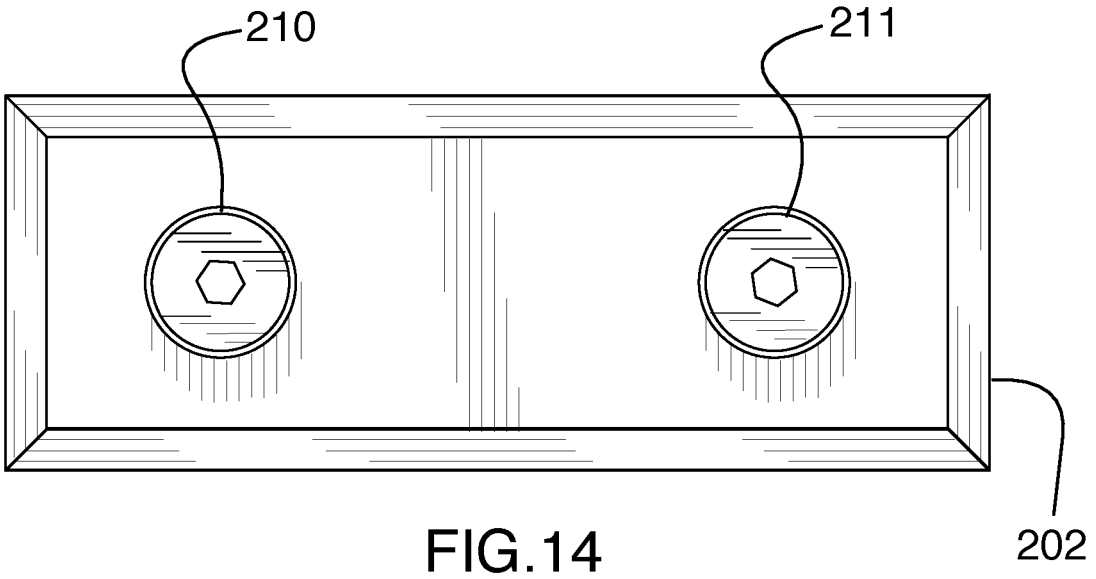
FIG. 14 shows a right side view of the 2 axis symmetry mounting system.

FIG. 14 shows the outside of bracket 202. The fasteners 210 and 211 may be of any type. In this example the fasteners are socket head screws. Any number of fasteners may be used. In this example two fasteners are used.

Figure 15:
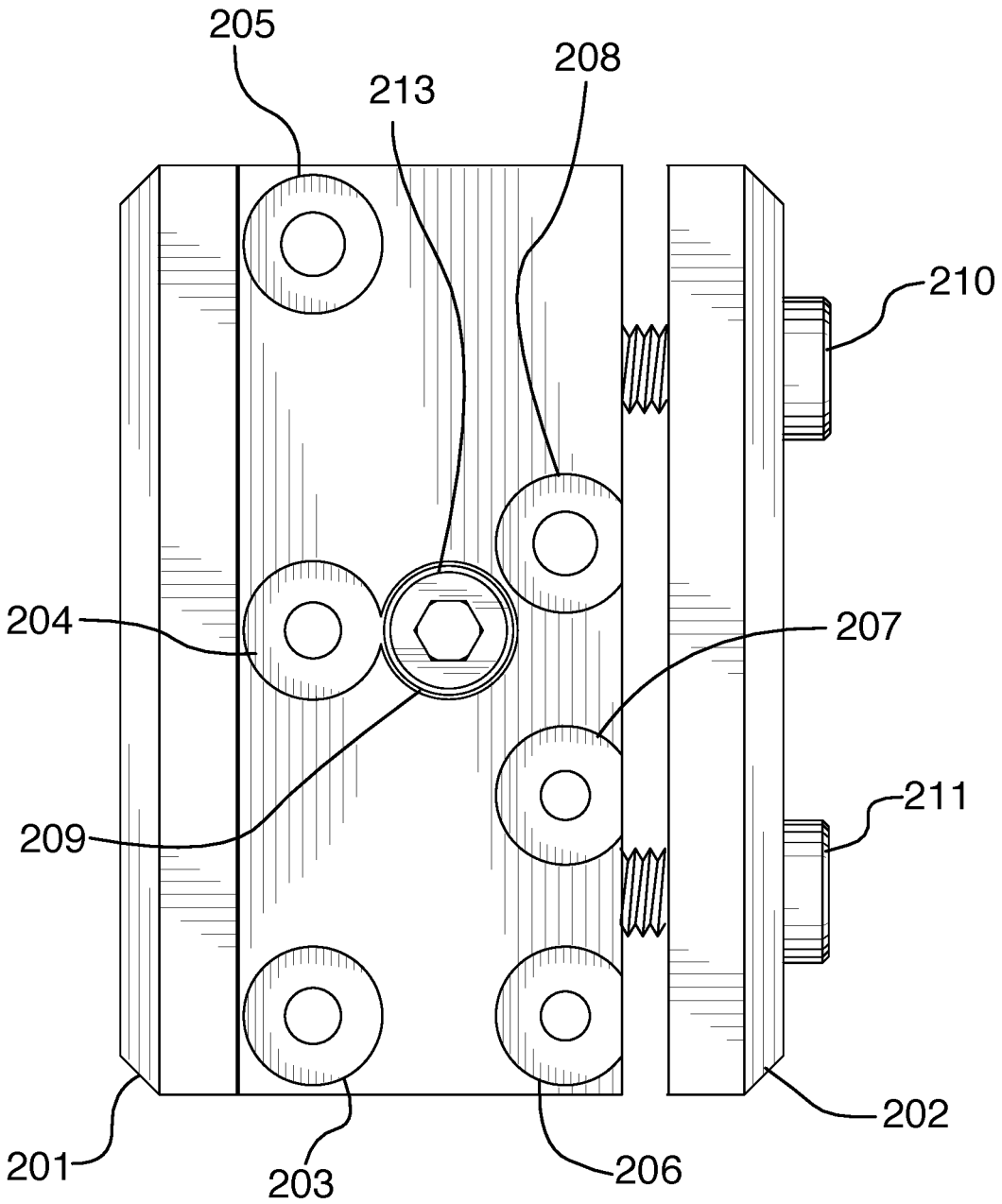
FIG. 15 shows an example of recoil locking screw hole positions with the 2 axis symmetry mounting system.

FIG. 15 shows some of the almost limitless recoil retaining screw hole positions and sizes. In this example three recoil retaining screw holes 205, 208, and 213 are suitable for #5 screws and could be used with a Picatinny rail. Additionally, in this example two recoil retaining screws 203, and 204 are suitable for #4 screws and could be used with a Weaver rail. Additionally, in this example two recoil retaining screws 206, and 207 are suitable for #3 screws and could be used with a Glock rail. By making the recoil retaining screw hole positions asymmetrical along the length of the bracket 201 the position of the accessory on the gun rail can be varied by flipping the direction of the mounting brackets along the gun rail.

Figure 16:
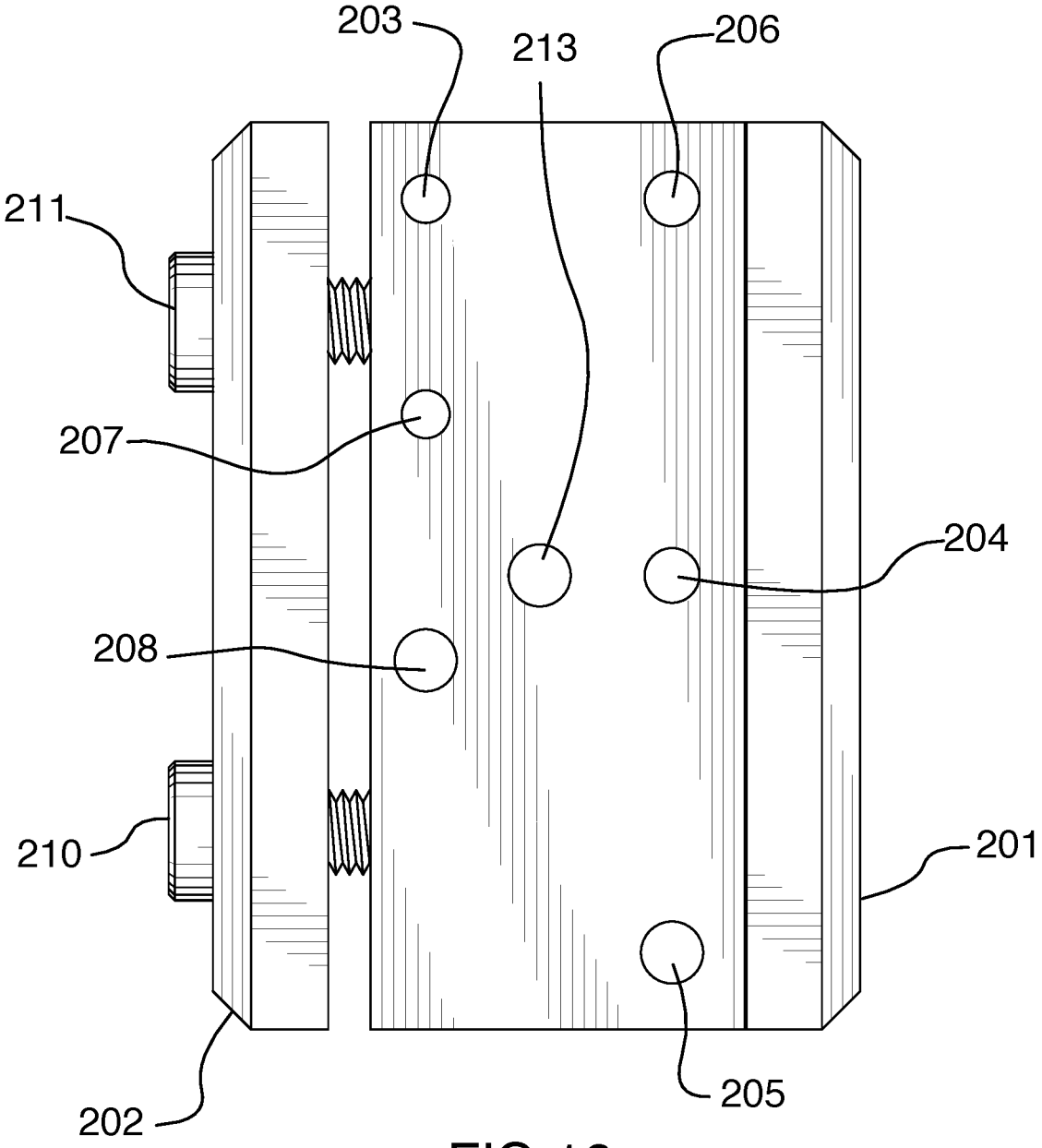
FIG. 16 shows an example of recoil locking screw hole positions on opposite side to FIG. 15.

FIG. 16 shows the opposite side to FIG. 15 and again shows that the accessory and gun rail can be on interchangeable sides of the mounting brackets 201 and 202.

Figure 17A:
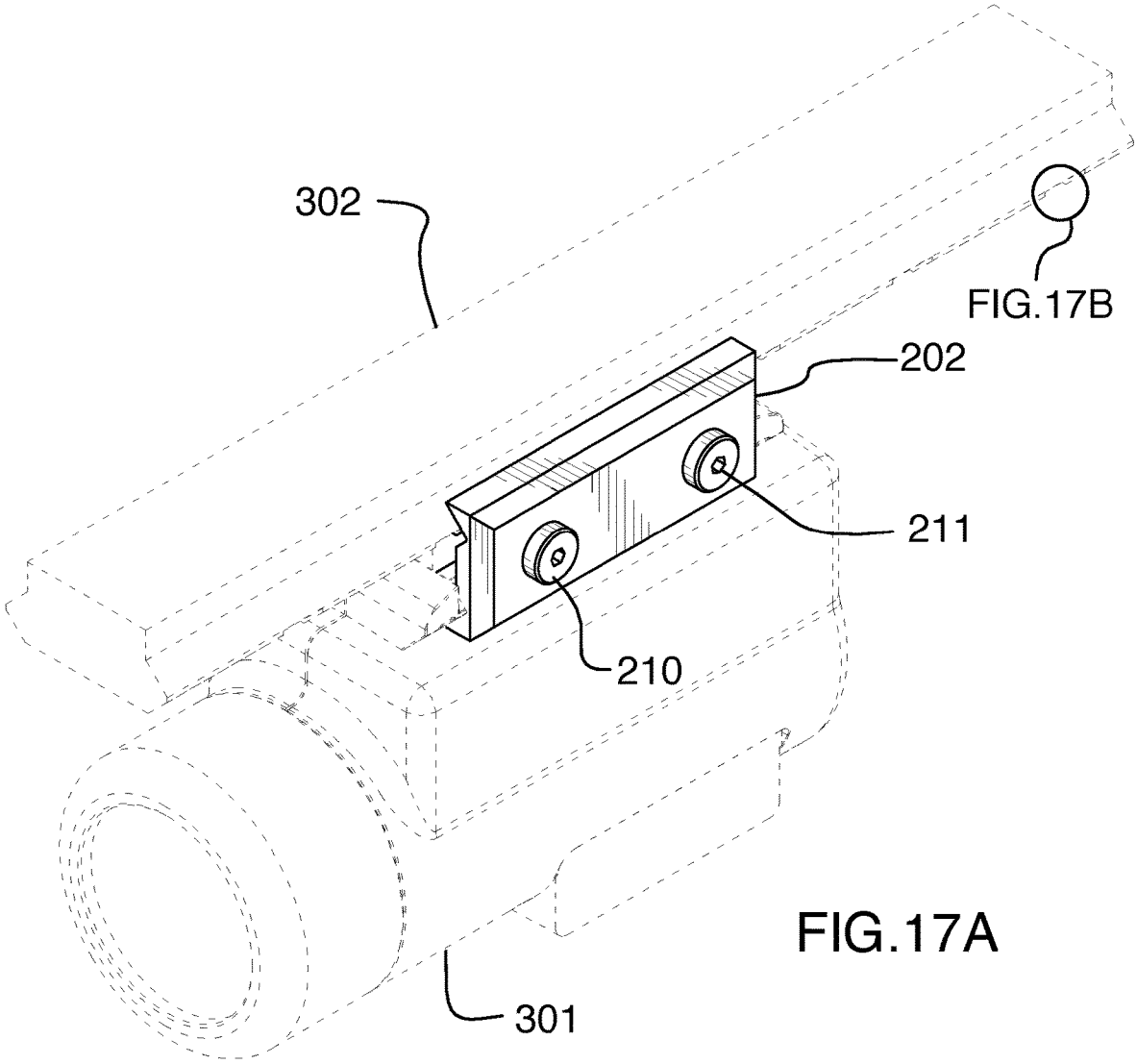
FIG. 17A and FIG. 17B illustrates an example of a video camera mounted on a PICATINNY rail using either the 2 axis or 3 axis symmetry mounting systems.
Figure 17B:
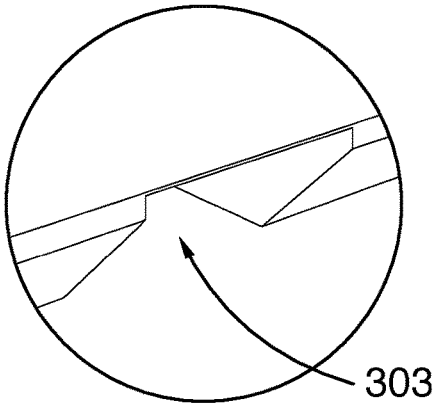

FIG. 17A and FIG. 17B illustrates the example of the invention being used to mount a gun camera 301 on to a PICATINNY rail 302. Details of a series of recoiling locking slots 303 are shown in FIG. 17B.

It should be noted that some features of the present disclosure may be used in one embodiment thereof without use of other features of the present disclosure. As such, the foregoing description should be considered as merely illustrative of the principles, teachings, examples, and exemplary embodiments of the present disclosure, and not a limitation thereof.

Also note that these embodiments are only examples of the many advantageous uses of the innovative teachings herein. In general, statements made in the specification of the present application do not necessarily limit any of the various claimed disclosures. Moreover, some statements may apply to some inventive features but not to others.

What is claimed:

1. A gun rail accessory mounting system comprising:

two W-shaped mounting brackets with a plurality of threaded openings disposed in a first direction and a top triangular shaped slot and a bottom triangular shaped slot;

at least one mounting fastener oriented in a second direction, which is substantially perpendicular to the first direction, to hold the two W-shaped mounting brackets together with an accessory on one side of the two W-shaped mounting brackets and a gun rail on a second side of the two W-shaped mounting brackets;

at least one recoil retaining screw mechanically engaged with at least one of the plurality of threaded openings allowing a suitable recoil locking device to be used with a recoil locking slot used for a chosen gun rail; and wherein the two W-shaped mounting brackets are held together with the at least one mounting fastener, the mounting system has a form factor that is symmetrical in two axes, and the top triangular shaped slot of each of the two W-shaped mounting brackets is used to clamp on the gun rail and the bottom triangular shaped slot of each of the two W-shaped mounting brackets is used to clamp a camera.

2. The gun rail accessory mounting system according to claim 1, wherein the at least one mounting fastener is a screw which fit through one mounting bracket, of the two W-shaped mounting brackets, with a hole and fit into another mounting bracket, of the two W-shaped mounting brackets, with a threaded hole.

3. The gun rail accessory mounting system according to claim 1, wherein the plurality of threaded openings disposed in the first direction with a position of the threaded openings being set to allow the accessory to be positioned on the gun rail in a variety of positions along the gun rail while engaging the recoil locking slot in a gun rail.

4. The gun rail accessory mounting system according to claim 1, wherein the plurality of threaded openings disposed in the first direction includes a countersink, with a depth of the countersink being set to allow a recoil locking screw height above a bracket face to fit the recoil locking slot.

5. The gun rail accessory mounting system according to claim 1, wherein the plurality of threaded openings disposed in the first direction whose positions are asymmetrical between one W-shaped mounting bracket of the two W-shaped mounting brackets and another W-shaped mounting bracket of the two W-shaped mounting brackets to allow the accessory to be positioned on the gun rail in a variety of positions along the gun rail while engaging the recoil locking slot on the gun rail.

6. The gun rail accessory mounting system according to claim 1, wherein the recoil retaining screw is anyone of a #3 standard screw size, a #4 standard screw size, and a #5 standard screw size, with a diameter of a screw head approximately matching a width of the recoil locking slot used for a GLOCK, a WEAVER, a PICATINNY, or other gun rails.

7. A gun rail accessory mounting system comprising:

two mounting brackets with similar W-shaped form factor with a plurality of threaded openings disposed in a first direction;

at least one mounting fastener oriented in a second direction, which is substantially perpendicular to the first direction, to hold the two mounting brackets together with an accessory on one side and a gun rail on a second side;

at least one recoil locking screw mechanically engaged with at least one of the plurality of threaded openings allowing a suitable recoil locking device to be used with a recoil locking slot used for a chosen gun rail; and wherein the two mounting brackets are held together with the at least one mounting fastener, and the mounting system has a form factor that is symmetrical in three axes, each substantially perpendicular to one another.

8. The gun rail accessory mounting system according to claim 7, wherein the at least one mounting fastener which fit through one mounting bracket, of the two mounting brackets, with a hole and fits into another mounting bracket, of the two mounting brackets, with a threaded hole.

9. The gun rail accessory mounting system according to claim 7, wherein the plurality of threaded openings disposed in the first direction with a position of the threaded openings being set to allow the accessory to be positioned on the gun rail in a variety of positions along the gun rail while engaging the recoil locking slot in a gun rail.

10. The gun rail accessory mounting system according to claim 7, wherein the plurality of threaded openings disposed in the first direction includes a countersink, with a depth of the countersink being set to allow a recoil locking screw height above a bracket face to fit the recoil locking slot.

11. The gun rail accessory mounting system according to claim 7, wherein the plurality of threaded openings disposed in the first direction whose positions are asymmetrical between one mounting bracket of the two mounting brackets and another mounting bracket of the two mounting brackets to allow the accessory to be positioned on the gun rail in a variety of positions along the gun rail while engaging the recoil locking slot on the gun rail.

12. The gun rail accessory mounting system according to claim 7, wherein the recoil locking screw is anyone of a #3 standard screw size, a #4 standard screw size, and a #5 standard screw size, with a diameter of a standard screw head approximately matching a width of the recoil locking slot used for a GLOCK, a WEAVER, a PICATINNY, or other gun rails.

* * * * *